US010342361B2

(12) United States Patent
Cotirla et al.

(10) Patent No.: US 10,342,361 B2
(45) Date of Patent: Jul. 9, 2019

(54) MULTI-FUNCTIONAL ENTERTAINER FOR A CHILD

(71) Applicant: Blue Box Toy Factory Limited, Kowloon (HK)

(72) Inventors: Adrian Cristian Cotirla, Chicago, IL (US); Jeffrey David Bricker, Chicago, IL (US); Brian Keith York, Chicago, IL (US)

(73) Assignee: BLUE BOX TOY FACTORY LIMITED, Hong Kong (HK)

( * ) Notice: Subject to any disclaimer, the term of this patent is extended or adjusted under 35 U.S.C. 154(b) by 0 days.

(21) Appl. No.: 15/955,308

(22) Filed: Apr. 17, 2018

(65) Prior Publication Data

US 2018/0317668 A1 Nov. 8, 2018

Related U.S. Application Data

(60) Provisional application No. 62/500,182, filed on May 2, 2017.

(51) Int. Cl.

| | |
|---|---|
| ***A47D 3/00*** | (2006.01) |
| ***A47D 11/00*** | (2006.01) |
| ***A47D 13/10*** | (2006.01) |
| ***A63H 33/00*** | (2006.01) |
| ***A47D 1/00*** | (2006.01) |
| ***A47D 15/00*** | (2006.01) |

(52) U.S. Cl.

CPC ..... *A47D 3/001* (2017.05); *A47D 1/008* (2013.01); *A47D 11/002* (2013.01); *A47D 13/107* (2013.01); *A47D 15/00* (2013.01); *A63H 33/006* (2013.01)

(58) Field of Classification Search

CPC ..... A47D 13/107; A47D 11/002; A47D 3/001
See application file for complete search history.

(56) References Cited

U.S. PATENT DOCUMENTS 1,950,042 A * 3/1934 Upper ..... A47D 13/107 297/136
5,451,093 A * 9/1995 Petrie ..... A47D 1/002 248/618
5,584,531 A * 12/1996 Bowman ..... A47D 1/008 108/25
5,688,211 A * 11/1997 Myers ..... A47D 13/107 297/5
5,690,383 A * 11/1997 Meeker ..... A47D 13/107 297/274
5,728,030 A 3/1998 Hsieh
(Continued)

FOREIGN PATENT DOCUMENTS

EP 3075283 A1 * 10/2016 ..... A47D 1/004
FR 1125380 A * 10/1956 ..... A47D 1/004

*Primary Examiner* — Timothy J Brindley
(74) *Attorney, Agent, or Firm* — Stetina Brunda Garred and Brucker; Mark B. Garred

(57) ABSTRACT

An entertainer for a child that is specifically configured and adapted for use in several operational configurations. The entertainer includes a plurality of legs and a tray for supporting a plurality of activity items for the child. A multi-functional plate is attachable to the legs to allow the entertainer to assume a seat support configuration. The multi-functional plate is detachable from the legs and positionable over the tray to allow the entertainer to assume a table top configuration.

21 Claims, 14 Drawing Sheets

(56) References Cited

U.S. PATENT DOCUMENTS 5,857,944 A * 1/1999 Cone ..... A47D 13/043 297/274
5,934,747 A * 8/1999 Garland ..... A47D 11/00 297/136
6,000,750 A 12/1999 Rossman et al.
6,179,376 B1 1/2001 Meeker et al.
6,425,842 B1 7/2002 Stern et al.
6,595,780 B2 7/2003 Singh et al.
6,637,814 B1 10/2003 Bellows et al.
6,682,139 B2 1/2004 Bellows et al.
6,715,826 B2 4/2004 Bellows et al.
6,854,799 B1 * 2/2005 Asbach ..... A47D 3/00 297/136
6,896,575 B2 5/2005 Fair et al.
7,044,892 B2 * 5/2006 Stern ..... A47D 3/005 434/255
D553,865 S 10/2007 Buitendach
7,287,768 B2 10/2007 Myers et al.
7,510,238 B2 3/2009 McClintock et al.
7,523,984 B2 4/2009 Steininger
7,614,979 B2 11/2009 Thomson et al.
7,740,560 B2 * 6/2010 Tadin ..... A47D 3/00 482/27
8,303,033 B2 11/2012 Lundeen
8,708,875 B2 4/2014 Prohaska et al.
8,870,668 B2 10/2014 Keller et al.
8,944,514 B2 2/2015 Tadin et al.
9,010,711 B2 4/2015 Pleiman et al.
9,185,994 B2 11/2015 Burns et al.
2002/0043825 A1 4/2002 Bellows et al.
2002/0164917 A1 * 11/2002 Keegan ..... A47D 13/043 446/71
2003/0071495 A1 4/2003 Bellows et al.
2003/0071496 A1 4/2003 Bellows et al.
2005/0146106 A1 * 7/2005 Myers ..... A47D 3/00 280/87.051
2005/0221715 A1 10/2005 Fair et al.
2010/0320821 A1 * 12/2010 Trapp ..... A47D 13/107 297/274
2011/0241387 A1 * 10/2011 Lundeen ..... A47D 3/00 297/16.1
2012/0326409 A1 12/2012 Corso et al.
2013/0072081 A1 * 3/2013 Goszewski ..... A47D 13/107 446/71
2013/0306826 A1 * 11/2013 Pleiman ..... A47B 81/00 248/423
2016/0088954 A1 * 3/2016 Burns ..... A47D 1/008 297/258.1
2017/0232355 A1 * 8/2017 Healy ..... A47D 3/001 446/227
2018/0297623 A1 * 10/2018 Burns ..... A63H 33/006

* cited by examiner

MULTI-FUNCTIONAL ENTERTAINER FOR A CHILD

CROSS-REFERENCE TO RELATED APPLICATIONS

This application claims the benefit of U.S. Provisional Application Ser. No. 62/500,182, filed May 2, 2017, the contents of which are expressly incorporated herein by reference.

STATEMENT RE: FEDERALLY SPONSORED RESEARCH/DEVELOPMENT

Not Applicable

BACKGROUND

1. Technical Field

The present disclosure relates generally to an entertaining apparatus for a child, and more specifically to an entertaining apparatus transitional between at least two different operational configurations, while also being easily collapsible for storage.

2. Description of the Related Art

Child activity or entertainment devices (i.e., entertainers) are well known and are intended to provide a comfortable and secure environment for a child, while also being a source for entertainment and stimulation for the child. Given that young children are rapidly developing mentally, as well as physically, continued stimulation and interaction is considered vital in the continued physical and mental development of the child. Therefore, entertainers provide many benefits to the child, while also provide peace of mind to the child's caretaker, that the child is safe and secure.

Many conventional entertainers include an upper tray area defining a circular opening for receiving a seat, which supports the child. The tray may be elevated over an underlying support surface via a plurality of legs. The tray may include toys, games, or other items for entertaining or occupying the child.

While entertainers have been widely used for entertaining a child, there are various drawbacks associated with conventional entertainers. One particular drawback is that the entertainer is typically usable in a single operational configuration, which includes placing the child in the seat to allow the child to interact with the items on the tray. Conventional entertainers are typically not configured for use in other operational configurations, particularly operational configurations with the child outside of the seat. Most entertainers tend to be large and bulky in size, and therefore occupy a lot of space, which may be difficult to justify, particularly in smaller spaces, when the entertainer can only be used in a single operational mode.

Another drawback with certain existing entertainers is that they may be difficult to store. As noted above, the entertainer may include several legs coupled to the tray. While certain entertainers allow for the legs to be collapsed against the tray, the process of collapsing the legs may be difficult.

Accordingly, there is a need in the art for an improved entertainer, configured for use in more than one operational mode, and which is easily transitional to a collapsed configuration for storage. Various aspects of the present disclosure address this particular need, as will be discussed in more detail below.

BRIEF SUMMARY

In accordance with one embodiment of the present disclosure, there is provided an entertainer for a child that is specifically configured and adapted for use in several operational configurations. The entertainer includes a plurality of legs and a tray for supporting a plurality of activity items for the child. A multi-functional plate is attachable to the legs to allow the entertainer to assume a seat support configuration. The multi-functional plate is detachable from the legs and positionable over the tray to allow the entertainer to assume a table top configuration.

The entertainer may include a strap assembly coupled to the multi-functional plate, and adapted to selectively connect the multi-functional plate to one or more of the legs, or to connect the multi-functional plate to the tray.

According to another aspect of the disclosure, there is provided an entertainer for a child comprising a tray having a central opening extending around a central axis. A seat is coupled to the tray adjacent the central opening. A plurality of hinged toys are pivotally coupled to the tray, with each hinged toy being transitional between an upright position and a hinged position. At least a portion of each hinged toy moves toward the central axis as the hinged toy transitions from the upright position toward the hinged position. Other toys are releasably attachable to corresponding, complementary rails or tracks configured to provide a unique mode of play or interaction. A plate is selectively positionable on the tray and is configured to extend over the seat and each of the hinged toys, those removed from the rails optionally being stored within the seat of the entertainer. Each hinged toy includes a portion extending between the seat and the plate when the plate is positioned on the tray and the respective toy is in the hinged position.

According to yet another aspect of the disclosure, there is provided an entertainer comprising a tray having a central opening, and a seat coupled to the tray adjacent the central opening. A leg is coupled to the tray. A pivot plate is coupled to the leg and includes a pivot groove formed therein. A pivot pin defines a pin axis, with the pivot pin extending in the pivot groove. The pivot pin and pivot groove are collectively configured to restrict movement of the pivot pin when the pivot pin is in a first axial position and a first portion of the pivot pin is in a first portion of the pivot groove. The pivot pin is moveable along the pin axis from the first axial position to cause the first portion of the pivot pin to move out of the pivot groove and allow for selective movement of another portion of the pivot pin within the pivot groove. The pivot pin is positionable in a second axial position along the pin axis to create an interference, but not necessarily a robust lock, between the pivot pin and the pivot plate.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

Figure 1:
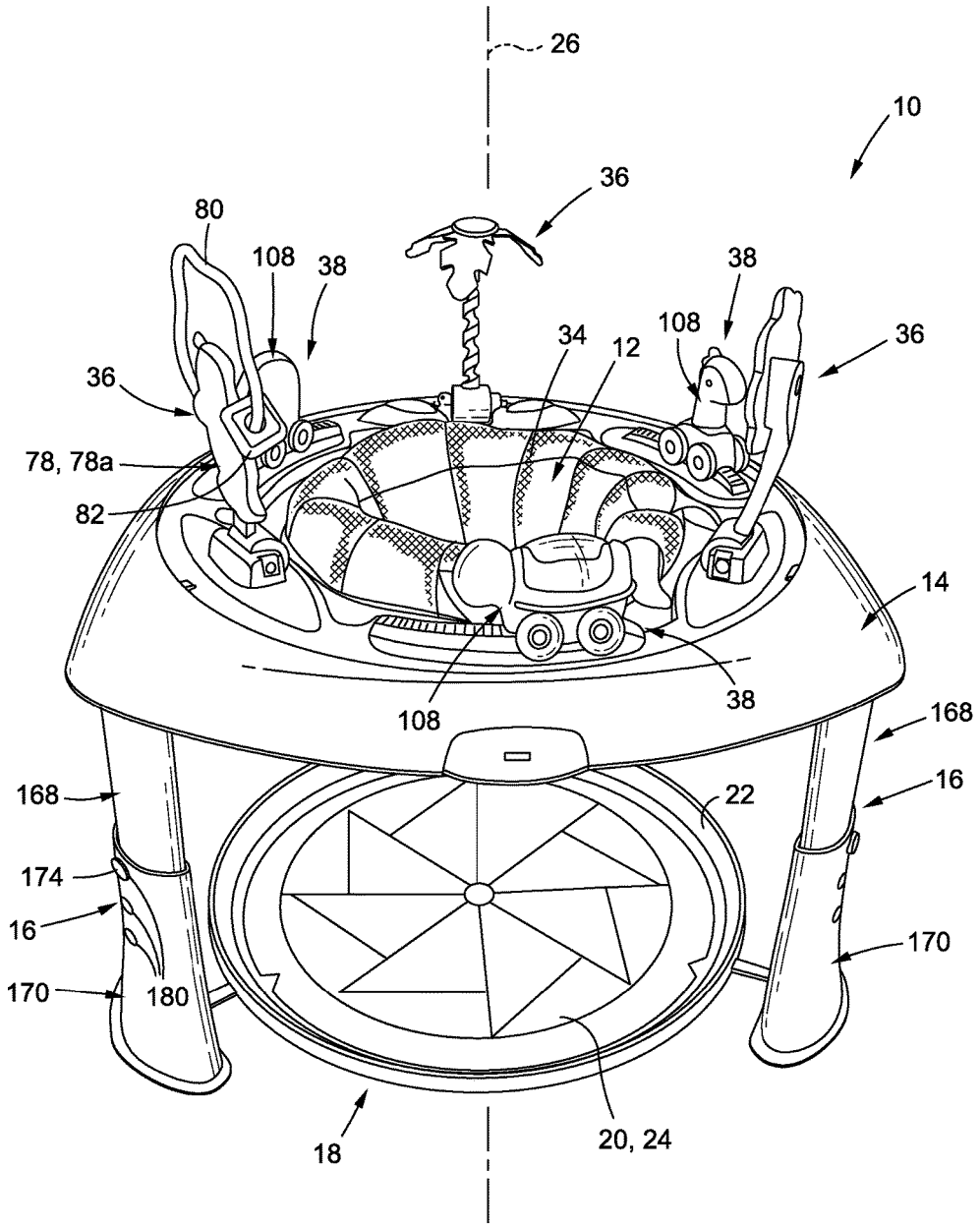
FIG. 1 is an upper perspective view of an entertainer constructed in accordance with the present disclosure, the entertainer being depicted in an exemplary seat support configuration.

The detailed description set forth below in connection with the appended drawings is intended as a description of certain embodiments of an entertainer for a child and is not intended to represent the only forms that may be developed or utilized. The description sets forth the various structure and/or functions in connection with the illustrated embodiments, but it is to be understood, however, that the same or equivalent structure and/or functions may be accomplished by different embodiments that are also intended to be encompassed within the scope of the present disclosure. It is further understood that the use of relational terms such as first and second, and the like are used solely to distinguish one entity from another without necessarily requiring or implying any actual such relationship or order between such entities.

Referring now to the drawings, wherein the showings are for purposes of illustrating a preferred embodiment of the present disclosure only, and not for purposes of limiting the same, there is depicted an entertainer 10 for a child. As will be described in more detail below, the exemplary entertainer 10 incorporates several unique and novel features when compared to conventional entertainers, including but not limited to, tray-mounted folding toys and rail stations, a selectively positionable multi-purpose plate, a strap assembly for connecting the multi-purpose plate in different positions on the entertainer, and a unique pivoting mechanism which allows for pivoting of entertainer support legs for easy stowing and deployment.

The general structure of the entertainer 10 includes a centrally located seat 12, a tray 14 surrounding the seat 12, a plurality of support legs 16 coupled to the tray 14, and a multi-purpose plate 18. The entertainer 10 shown in FIG. 1 is in a seat support configuration, with the multi-purpose plate 18 connected to the legs 16 and the seat 12 being exposed to allow a child to be placed in the seat 12 and stand on the multi-purpose plate 18. In the seat support configuration, the multi-purpose plate 18 is attached to a lower end portion of the legs 16, while the tray 14 is connected to an upper end portion of the legs 16. The legs 16 are adjustable in length to allow for adjustment of the overall height of the entertainer 10, i.e., the distance between the lower ends of the legs 16 and the tray 14.

The multi-purpose plate 18 generally includes a main body 20, and a peripheral sidewall 22 extending circumferentially around the main body 20. In the seat support configuration, and as viewed from the perspective shown in FIG. 1, the peripheral sidewall 22 extends upwardly from the main body 20, and the main body 20 is adapted to provide a stable surface that the child can stand on. By standing on the multi-purpose plate 18, the child is prevented from standing and walking away with the entertainer 10. The multi-purpose plate 18 is not intended to function as a trampoline, and thus, does not provide a trampoline effect to a child placed in the entertainer 10. An interchangeable design insert 24 may be placed over the main body 20 to enhance the overall look of the multi-purpose plate 18.

Figure 3:
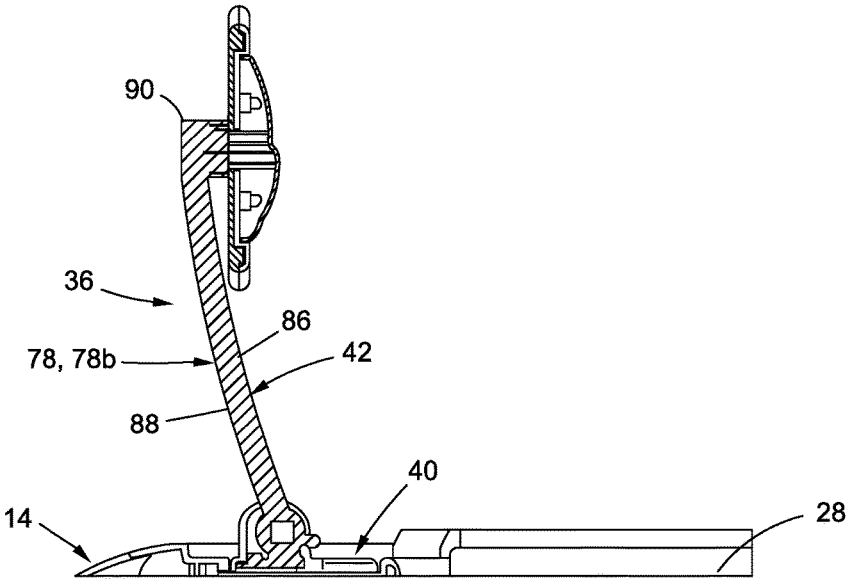
FIG. 3 is a partial side, cross-sectional view of the entertainer, depicting the exemplary hinged toy from FIG. 2 in the deployed position.
Figure 4:
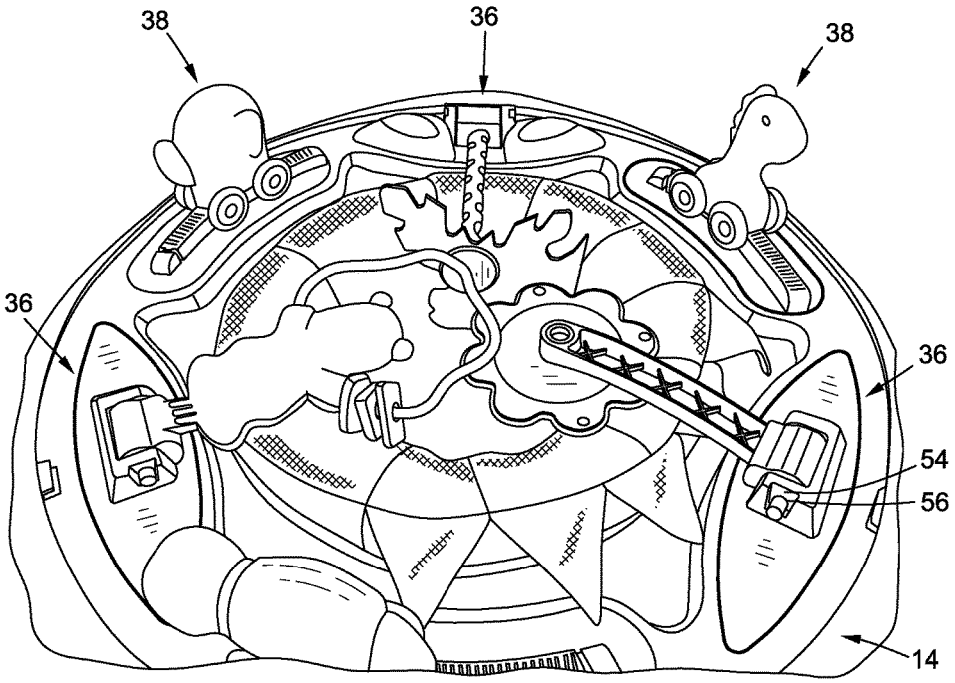
FIG. 4 is an enlarged upper perspective view of the entertainer, depicting the plurality of rail stations and hinged toys included therein, the hinged toys each being shown as articulated to a respective collapsed position relative to the tray.
Figure 5:
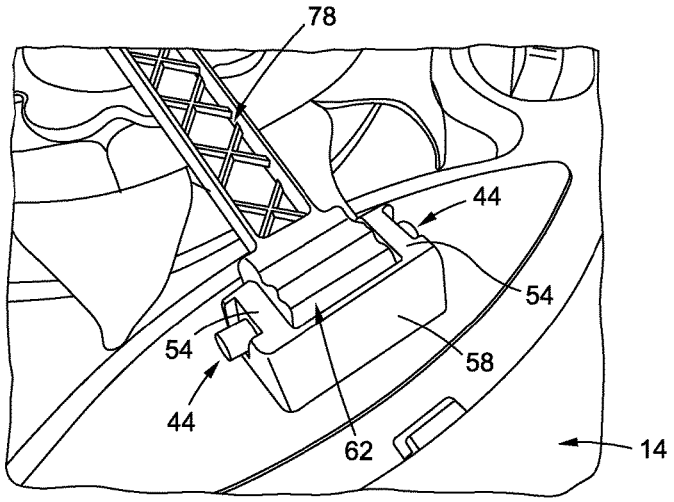
FIG. 5 is an enlarged view of a portion of the entertainer similar to FIG. 2, but depicting one of the hinged toys in its collapsed position relative to the tray.
Figure 6:
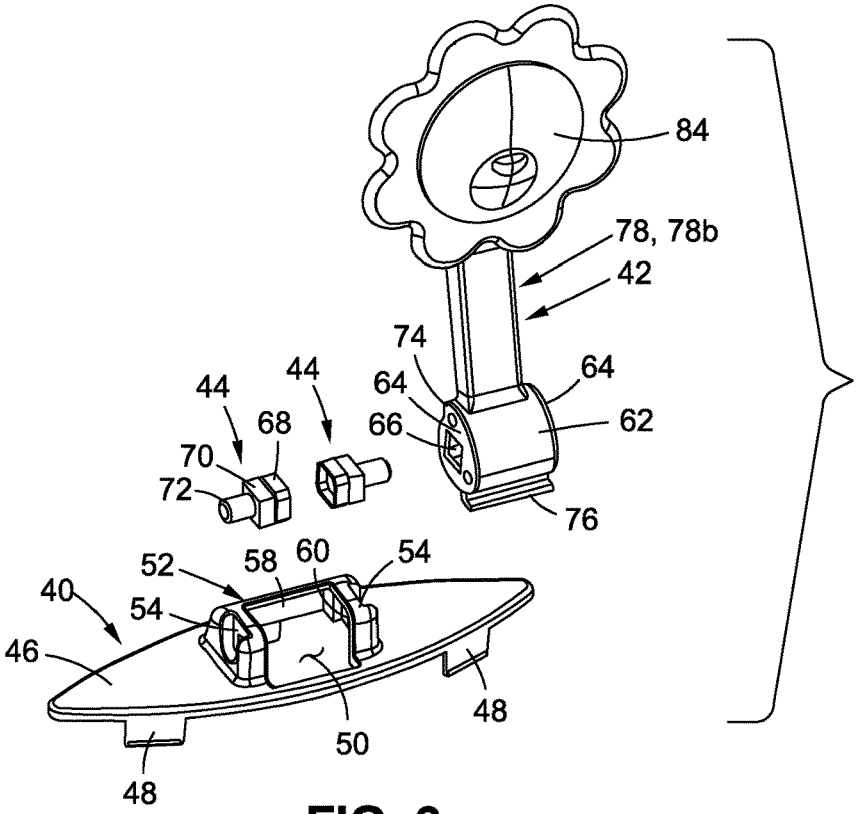
FIG. 6 is an exploded view of one of the hinged toys of the entertainer, and in particular that exemplary toy depicted in FIGS. 2, 3 and 5, the remaining hinged toys having like structures to facilitate their hinged, pivotal connection to the tray.
Figure 8:
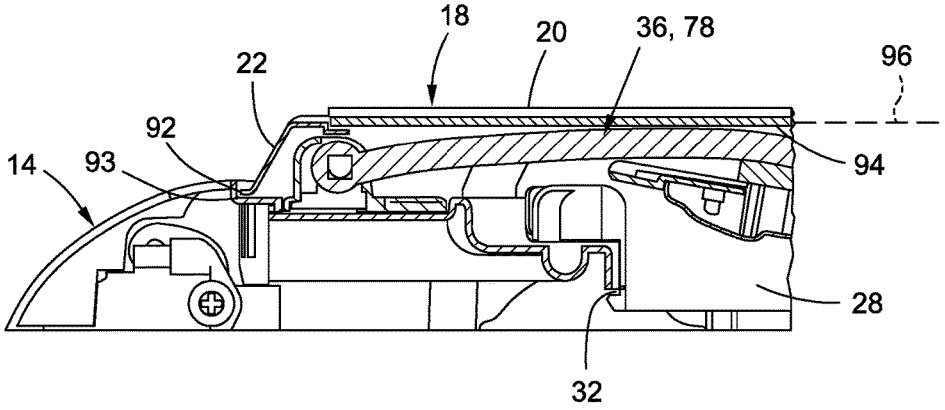
FIG. 8 is a partial side, cross-sectional view similar to FIG. 3, but depicting the entertainer in the table top configuration, the exemplary hinged toy from FIGS. 2, 3 and 5-7 being shown in its collapsed position.

The entertainer 10 defines a central axis 26 which passes through the seat 12, and about which the tray 14 is disposed. As shown in FIGS. 3 and 8, the seat 12 includes an annular support ring 28 disposed about the central axis 26, with the annular support ring 26 being coupled to the tray 14 and extending within a central opening 30 (see FIG. 10) formed in the tray 14. The support ring 26 may include a circumferential groove 32 which receives an inner-most portion of the tray 14 to maintain engagement between the support ring 26 and the tray 14. A fabric covering 34 is placed over and coupled to the support ring 26. The fabric covering 34 extends downwardly through the central opening 30 of the tray 14 to form the seating structure upon which the child is supported. The fabric covering 34 includes a pair of leg openings to allow the child's legs to extend downwardly when placed in the entertainer 10. The fabric covering 34 may include various designs, patterns, or other indicia which are pleasing to the child.

It is contemplated that the seat 12 may be adapted to rotate relative to the tray 14 about the central axis 26 to allow the child to twist when placed in the entertainer 10. Rotation of the seat 12 relative to the tray 14 may be effectuated via one or more bearings positioned between support ring 28 and the tray 14.

Attached to the tray 14 are a plurality of toys which the child may play with while located within the entertainer 10. The toys include hinged toys 36 and rail stations 38 located around the seat 12. Specifically, three hinged toys 36 and three rail stations 38 are alternately disposed about the seat 12, though the number of each of these play features and their arrangement on the tray may be varied from that shown in FIGS. 1 and 3 without departing from the spirit and scope of the present disclosure.

Figure 2:
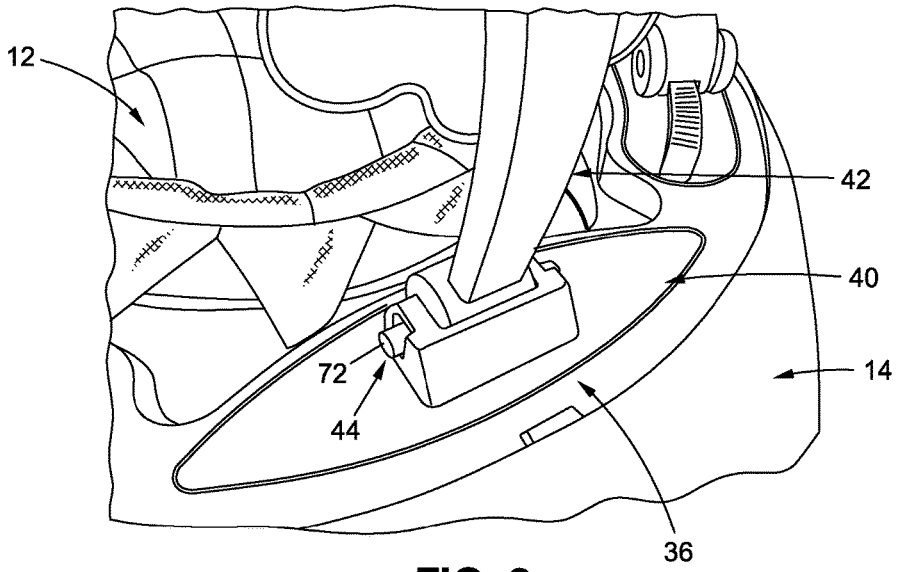
FIG. 2 is an enlarged view of a portion of the entertainer depicting an exemplary one of several hinged toys which are coupled to a tray, the hinged toy being depicted in an extended or deployed position relative to the tray.

Referring now specifically to FIGS. 2-9, each hinged toy 36 generally includes a hinge base 40, a hinge arm 42, and an identically configured pair of locking pins 44 interconnecting the hinge arm 42 to the hinge base 40. The hinged toy 36 is selectively transitional between a deployed position, as shown in FIGS. 1-3, and a collapsed position, as shown in FIGS. 4-5 and 7-8. The hinge arm 42 is moved toward the tray 14 to decrease an angle between the hinge arm 42 and the tray 14 as the hinged toy 36 transitions from the deployed position toward the collapsed position. Conversely, the hinge arm 42 is moved away from the tray 14 to increase an angle between the hinge arm 42 and the tray 14 as the hinged toy 36 transitions from the collapsed position toward the deployed position.

The hinge base 40 includes a plate 46 and a plurality of tabs 48 extending downwardly from the plate 46, with the tabs 48 being configured to be received into corresponding grooves formed in the tray 14 to allow for securement of the hinge base 40 to the tray 14. The hinge base 40 further includes an opening 50 formed in the plate 46, and a hinge mount 52 extending from the plate 46 partially around the opening 50. The hinge mount 52 includes a pair of opposed walls 54, each having an opening 56 extending therethrough, and a wall 58 extending between the pair of opposed walls 54. A generally quadrangular recess 60 is formed on the inner surface of each wall 54, which is complimentary in shape to a portion of the locking pins 44, the purpose of such complimentary configuration being described in more detail below. A void or space is formed opposite the wall 58 to accommodate the hinging action of the hinge arm 42. The hinge base 40 is connected to the tray 14 such that the void or space opens up toward the entertainer seat 12, and the wall 58 is positioned away from the seat 12 relative to the void. This arrangement allows the hinged toy 36 to pivot toward the seat 12 and assume a collapsed position.

The hinge arm 36 includes a hinge body 62 adapted to be received within the hinge mount 52. The hinge body 62 includes a pair of opposed planar surfaces 64, and recesses 66 extending into the hinge body 62 from each planar surface 64. The recesses 66 are co-axially aligned with each other, and may also be in communication with each other, and thus, form a single void extending completely through the hinge body 62. Alternatively, the recesses 66 may each extend only partially through the hinge body 62, and thus, may be formed separate from each other. The recesses 66 are complimentary in shape to portions of the locking pins 44.

Each locking pin 44 includes a first quadrangular (e.g., square) portion 68, a second quadrangular (e.g., square) portion 70 slightly smaller than the first quadrangular portion 68, and a cylindrical portion 72. Each locking pin 44 is moveable relative hinge base 40 and hinge arm 42 between a locked position and an unlocked position. In the locked position, the first quadrangular portion 68 is positioned in the hinge body 62, the second quadrangular portion 70 is seated within a respective quadrangular recess 60 in the hinge mount 52, and the cylindrical portion 72 extends through a respective opening 56 in the hinge mount 52 and protrudes therefrom by a first distance. When each locking pin 44 is in the locked position, the complimentary engagement between the second quadrangular portion 70 and the hinge mount 52 effectively prevents pivotal movement of the hinge arm 42 relative to the hinge base 40. Each locking pin 44 is transitioned from the locked position to the unlocked position by pressing on the cylindrical portion 72. As each locking pin 44 is transitioned from the locked position toward the unlocked position, such locking pin 44 is advanced into the recess 66 formed in the hinge body 62, which unseats the second quadrangular portion 70 from the recess 60 in the hinge mount 52 and moves the second quadrangular portion 70 into the recess 66 formed in the hinge body 62. The unseating of the second quadrangular portions 70 from the hinge mount recess 60 allows the hinge body 62 to pivot relative to the hinge base 40 about the cylindrical portions 72 of the locking pins 44. When the locking pins 44 are simultaneously actuated to the unlocked positions, the cylindrical portions 72 remain in a protruding configuration relative to the hinge mount 52, albeit by a second distance less than the first distance defined by the cylindrical portion 72 when the locking pins are in the locked position. In this regard, each cylindrical portion 72 defines a pivot axis about which the hinge arm 42 pivots as it transitions between the deployed position and the collapsed position. In order to pivot the hinge arm 42 relative to the hinge base 40, both locking pins 44 must be placed in their unlocked configuration. Furthermore, a spring (not shown) may be used to bias the locking pins 44 toward the locked configuration. For instance, the spring may reside in the hinge body 42 and bias the locking pins 44 away from each other.

The outer surface of the hinge body 62 located between the opposed planar surfaces 64 defines a curved, arcuate configuration having two distinct regions. A first region has a radius that is larger than that of a second region, resulting in the formation of a shoulder 74 extending between the two regions. The shoulder 74 functions as a stop or abutment by contacting the wall 58 when the hinged toy 36 is in the deployed position. The hinge arm 42 may also include an auxiliary stop 76 extending radially outward from the hinge body 62, which also serves as a stop or abutment by contacting the plate 46 of the hinge base 40 when the hinged toy 36 is in the deployed position. The use of both the shoulder 74 and the auxiliary stop 76 may allow for distribution of forces transferred between the hinge arm 42 and the hinge base 40 when the hinge arm 42 is in the deployed position to provide a stronger connection therebetween.

Extending from the hinge body 62 is a main body 78, which is specifically configured and adapted to define an extremely low profile when the hinged toy 36 is in the collapsed position. In the exemplary embodiment, the main bodies 78 of the three hinged toys 36 define two general configurations. The first general configuration is a character main body 78*a*, with the character being defined by a body that is generally thin and relatively flat. In the exemplary embodiment, the character main body 78*a* is in the shape of a hippo, although it is understood that the character main body 78*a* may assume the shape of any animal, character, or shape known in the art. The hippo includes a wire 80 extending from the arms of the hippo, and several toy elements 82 are captured on the wire 80 and are selectively moveable along the wire 80 to provide entertainment to the child. The flat configuration of the character main body 78*a* allows the character main body 78*a* to assume a low profile over the tray 14 when the hinged toy 36 assumes its collapsed position.

The other general configuration of the main bodies 78 is a shaft 78*b* having a toy element 84 coupled to a distal end portion thereof opposite the hinge body 62. According to one embodiment, the shaft 78*b* is a generally rigid body having a slightly arcuate configuration, which allows the shaft 78*b* to assume a low profile relative to the tray 14 when the hinged toy 36 is in the collapsed position. In particular, the shaft 78*b* includes a concave inner portion 86 facing toward central axis 26, and a convex outer portion 88 facing away from the central axis 26. In the exemplary embodiment, the shafts 78*b* are in the form of a palm tree truck and a flower stem, respectively, with the corresponding toy elements 84 being palm branches and flower petals which are each capable of spinning relative to the associated shaft 78*b*, although it is again understood that the shafts 78*b* and toy elements 84 may assume differing shapes without departing from the spirit and scope of the present disclosure, e.g., the flower stem and flower petals could be substituted with a generic support shaft 78*b* supporting a lion head surrounded by a mane.

The shaft 78*b* defines a length as the distance between the hinge body 62 and a distal tip 90 of the shaft 78*b*. Each shaft 78*b* is of a prescribed length which allows the distal tip 90 of the shaft 78*b*, and the toy element 84 coupled thereto to reside within the tray opening 30 when the hinged toy 36 is in the collapsed position. In this regard, by allowing the toy element 84 to reside in the tray opening 30, the toy element 84 does not interfere with the tray 14 when the hinged toy 36 is in the collapsed position. Rather, the configuration of the shaft 78*b* allows the shaft 78*b* to extend over the edge of the seat 12 and place the toy element 84 in the opening 30, so as not to increase the profile of the hinged toy 36.

Figure 7:
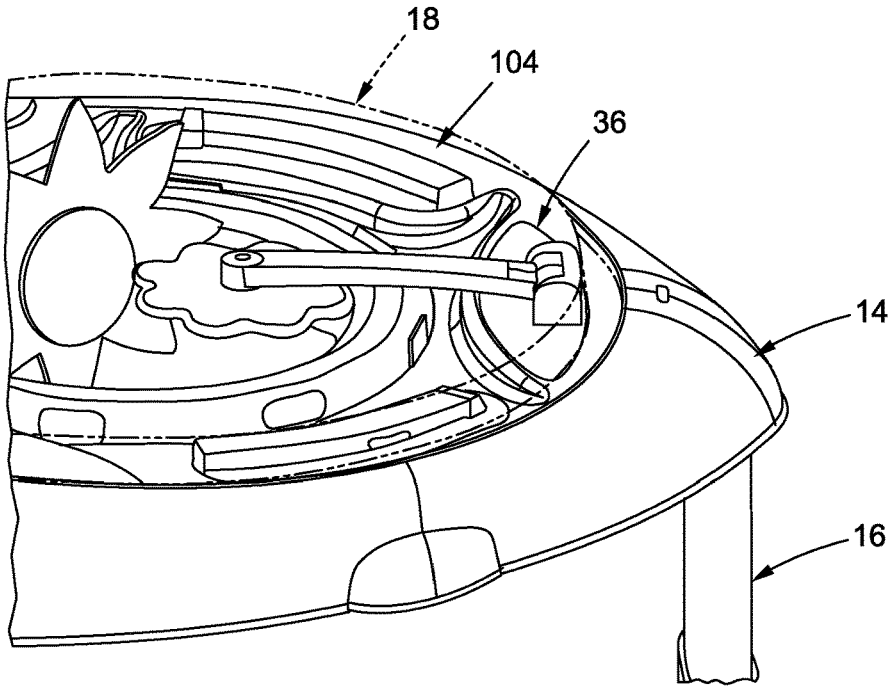
FIG. 7 is a partial, upper perspective view of the entertainer in a table top configuration with a multi-purpose plate being depicted in phantom, also showing the exemplary toy from FIGS. 2, 3, 5 and 6 in its collapsed state.
Figure 9:
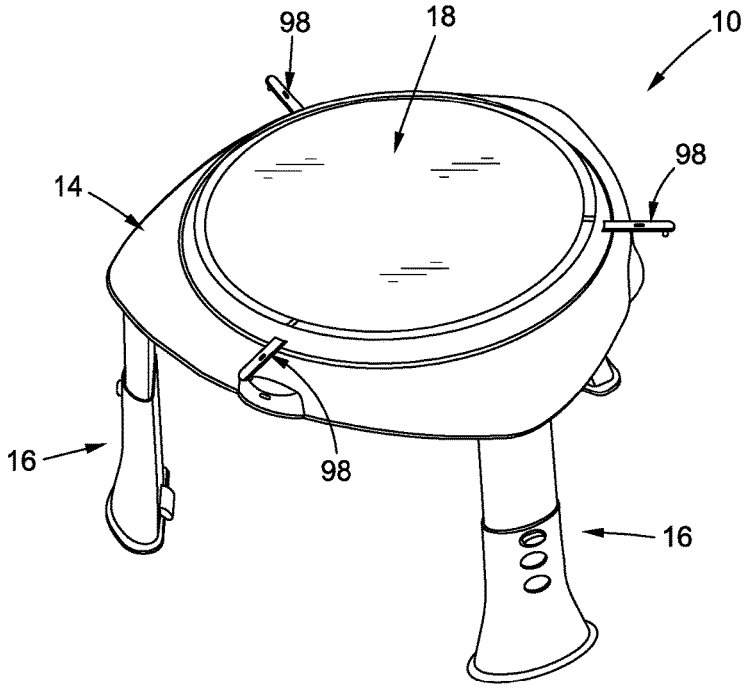
FIG. 9 is an upper perspective view of the entertainer in the table top configuration.

Referring now specifically to FIGS. 7-9, when all of the hinged toys 36 are in their collapsed positions, the entertainer 10 may assume the table top configuration, wherein the multi-purpose plate 18 is detached from the legs 16 and placed on top of the tray 14. In addition to transition of the hinged toys 36 to their collapsed positions, conversion of the entertainer 10 from the seat support configuration to the table top configuration may also require certain transition of the rail stations 38, with a more detailed discussion thereof being provided below.

When the multi-purpose plate 18 is placed on the tray 14, the multi-purpose plate 18 is inverted relative to its position in the seat support configuration. In particular, as viewed from the perspective shown in FIGS. 8 and 9, the peripheral sidewall 22 extends downwardly from the main body 20, with a distal rim 92 of the peripheral sidewall 22 engaging a groove 93 formed in the tray 14 to properly align the multi-purpose plate 18 relative to the tray 14. The multi-purpose plate 18 defines a diameter that is large enough to cover the seat 12, as well as the toys on the tray 14, and thus, allow the entertainer 10 to give the appearance and serve the function of a conventional children's table.

The ability of the hinged toys 36 to assume their collapsed position and to define an extremely low profile allows the multi-purpose plate 18 to fit over the hinged toys 36, without requiring the multi-purpose plate 18 to have an awkwardly large depth. In this regard, FIG. 8 depicts a side sectional view of hinged toy 36 in its collapsed position, and the multi-purpose plate 18 extending over the collapsed hinged toy 36. The multi-purpose plate 18 defines a depth as the distance between the distal rim 92 and the surface 94 of the main body 20. The "profile" of the hinged toy 36 is the distance between the groove 93 which receives the distal rim 92 of the multi-purpose plate 18, and the horizontal tangential plane 96 defined by the shaft 78*b*. According to one embodiment, the profile of the hinged toy 36 is less than the depth of the multi-purpose plate 18 to allow the shaft 78*b* of the hinged toy 36 to extend between the surface 94 of the main body 20, and the upper edge of the seat 12. When the multi-purpose plate 18 is in the table top configuration, a strap assembly comprising one or more straps 98 may be used to secure the multi-purpose plate 18 to the tray 14, as will be described in more detail below.

Figure 10:
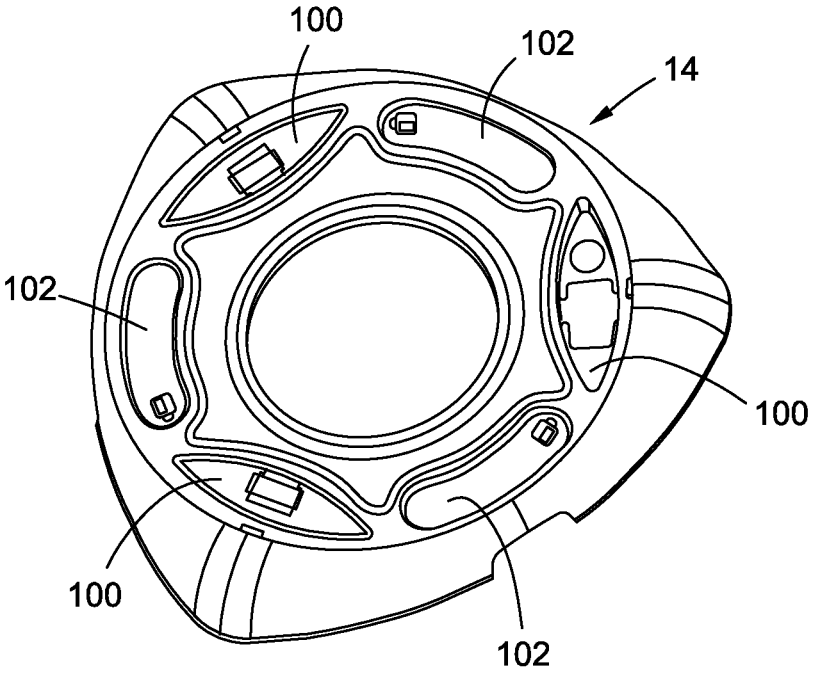
FIG. 10 is an upper perspective view of the tray included in the entertainer.

Referring now to FIGS. 10-16C, the details of the rail stations 38 and their attachment to the tray 14 are shown and will now be described. FIG. 10 is an upper perspective view of the tray 14, with all ancillary components being removed therefrom for purposes of illustrating details of the tray 14. In addition to the central opening 30 formed in the tray 14, the tray 14 includes a series of recesses or pockets extending from an upper surface thereof, with each pocket being configured to accommodate either a hinged toy 36 or a rail station 38. In the exemplary embodiment, the pockets 100 with the tapered ends are intended to accommodate a hinged toy 36, whereas the pockets 102 with the rounded ends are intended to accommodate a rail station 38. It is understood, the size, shape, number and arrangement of the pockets may vary without departing from the spirit and scope of the present disclosure. Furthermore, the pockets may include slots, grooves, apertures or the like to accommodate features of the corresponding hinged toy 36 or rail station 38.

Figure 11:
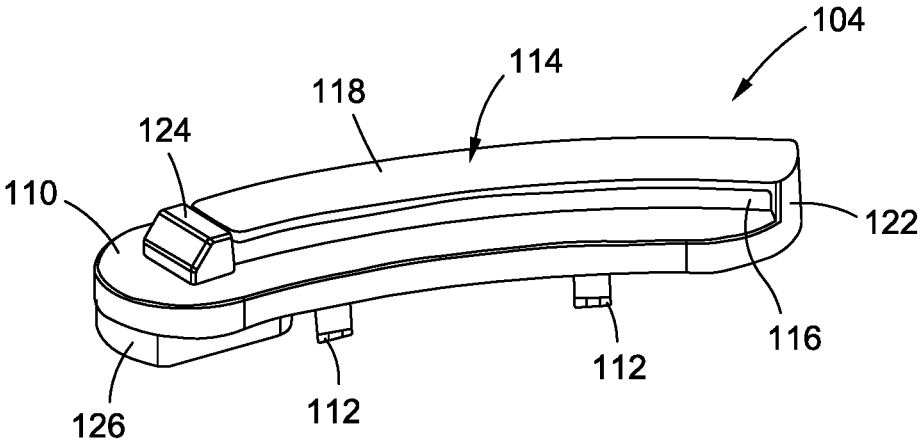
FIG. 11 is an upper perspective view of a rail station base of one of the several rail stations included in the entertainer.
Figure 12:
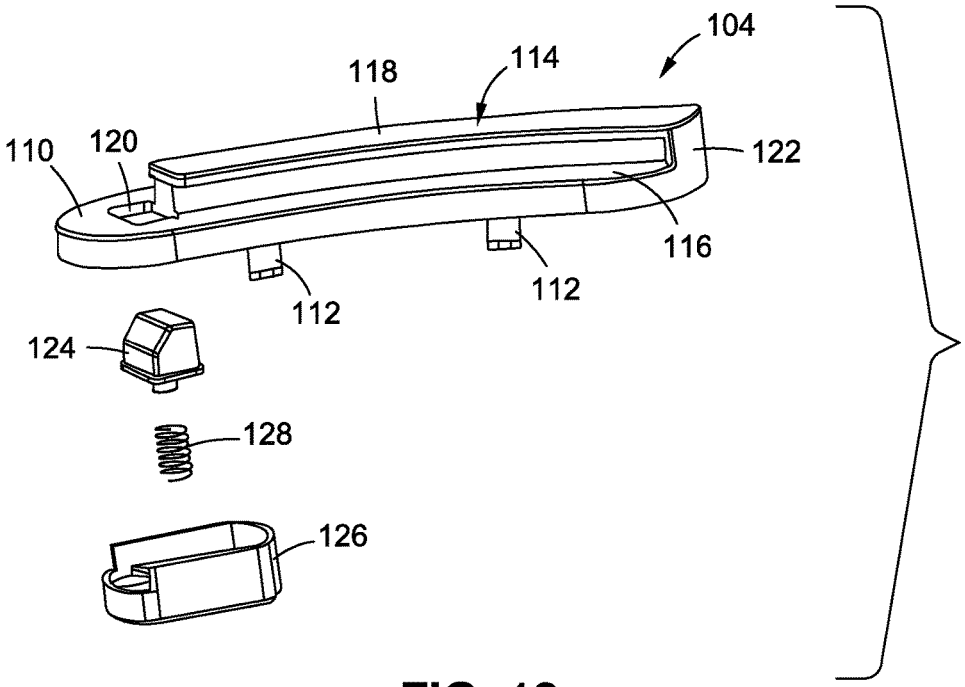
FIG. 12 is an exploded view of the rail station base shown in FIG. 11.
Figure 13:
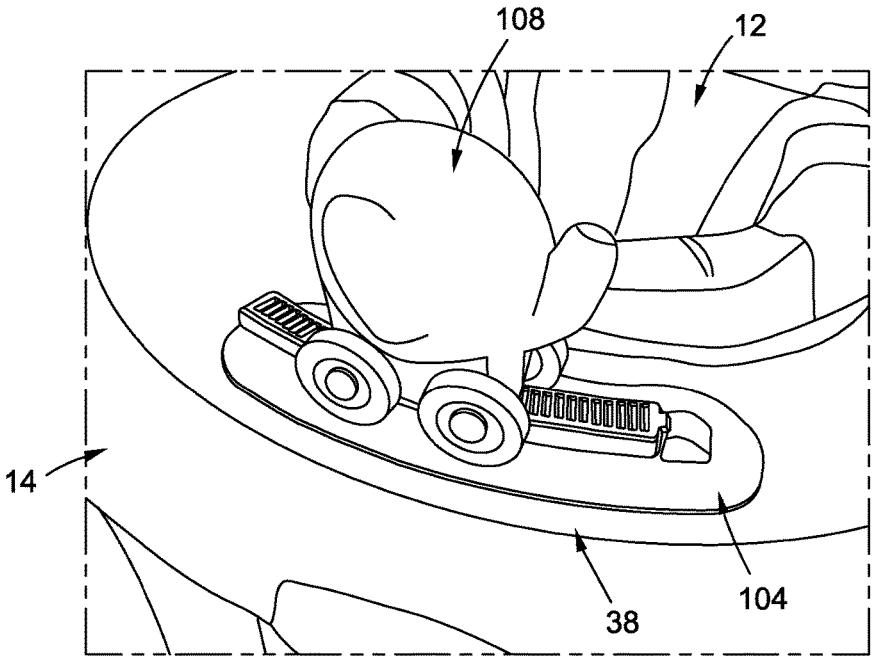
FIG. 13 is an enlarged upper perspective view of an exemplary one of the rail stations included in the entertainer.
Figure 14:
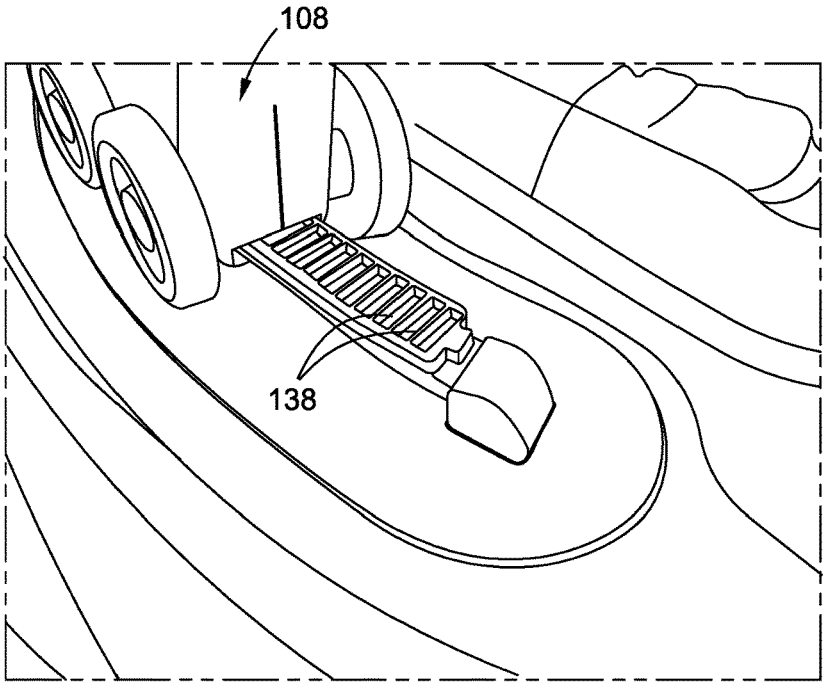
FIG. 14 is an enlarged view of the rail station shown in FIG. 13 depicting interconnection between the rail station base assembly and a corresponding rail toy.
Figure 15:
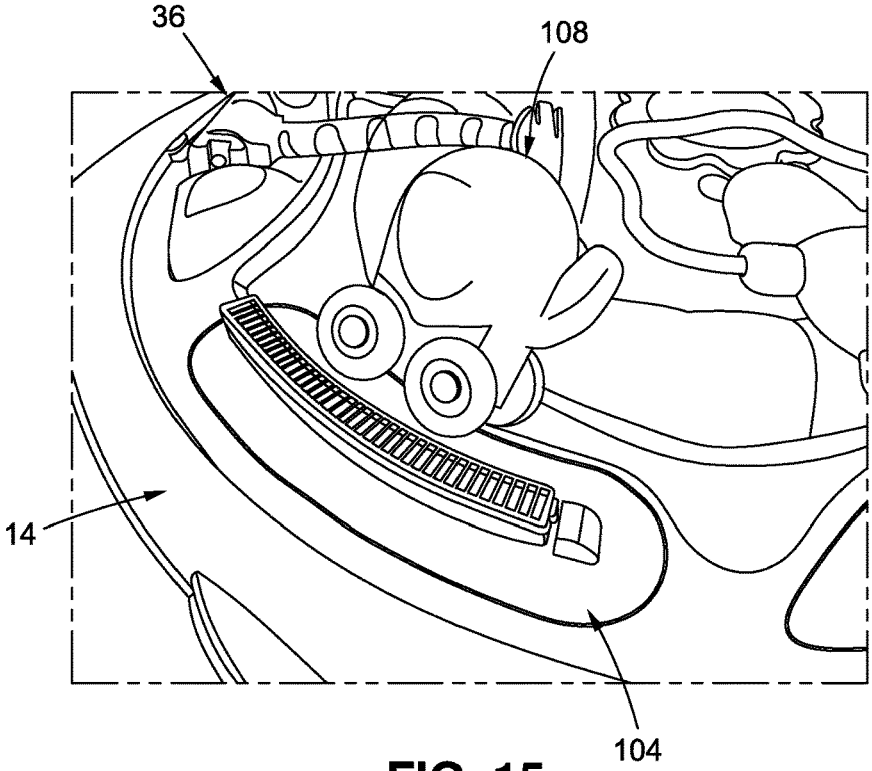
FIG. 15 is an enlarged view similar to FIG. 13 but depicting the rail toy as removed from the rail station base assembly.
Figure 16A:
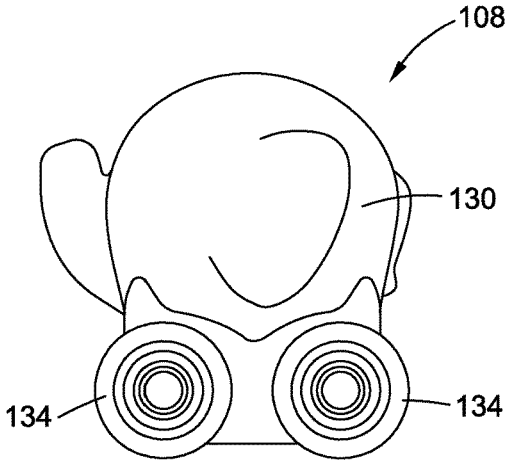
FIG. 16A is a side view of the exemplary embodiment of the rail toy shown in FIGS. 13-15.
Figure 16B:
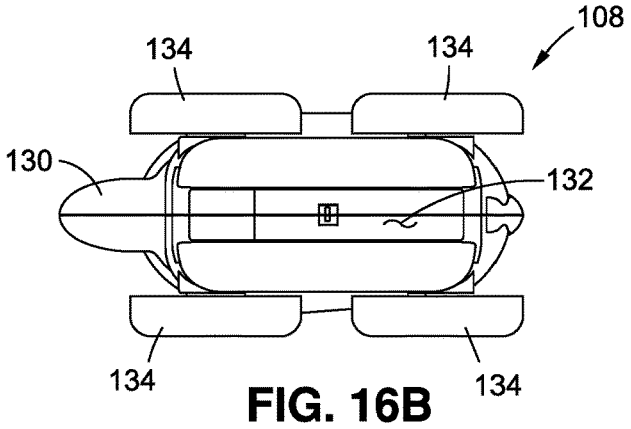
FIG. 16B is a bottom view of the rail toy depicted in FIG. 16A.
Figure 16C:
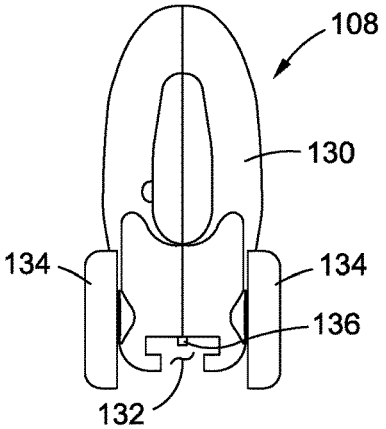
FIG. 16C is a rear view of the rail toy depicted in FIG. 16A.

Each rail station 38 includes a rail station base 104 and a toy element 108 detachably connectable to the rail station base 104. FIG. 11 is an upper perspective view of the rail station base 104, and FIG. 12 is an exploded view of the rail station base 104. The rail station base 104 includes a base plate 110 having a plurality of tabs 112 extending downwardly therefrom, with the tabs 112 being configured to facilitate attachment of the rail station base 104 to the tray 14. The rail station base 104 further includes a T-shaped rail 114 extending along an upper surface of the base plate 110 and including a stem wall 116 and a top wall 118 perpendicular to the stem wall 116 to define the T-shape. The rail 114 extends from a peripheral end of the base plate 110 and terminates at an opening 120 formed in the base plate 110. An end wall 122 extends from the top wall 118 of the rail 114 to the base plate 110 and outwardly from the stem wall 116 to function as a stop for the rail toy element 108.

The opening 120 is configured to accommodate a locking tab 124. The locking tab 124 is moveably mounted to the rail station base 104, and is transitional between a locked position and an unlocked position. The locking tab 124 is pressed into the opening 120 as the locking tab 124 transitions from the locked position toward the unlocked position. A cover 126 is attached to the base plate 110 and is adapted to enclose a spring 128 extending between the cover 126 and the locking tab 124 to bias the locking tab 124 toward the locked position.

The rail station base 104 accommodates the toy element 108 by allowing the toy element 108 to slide along the rail 114 between the locking tab 124 and the opposite end of the rail 114. The toy element 108 includes a main body 130 having a groove 132 formed in a lower portion of the main body 130. The groove 132 is complimentary in shape to the rail 114. Along these lines, the groove 132 includes a wide section, which accommodates the top wall 118 of the rail 114, and a narrow section, which accommodates the stem wall 116 of the rail 114. The toy element 108 may include wheels 134 to facilitate movement of the toy element 108 over the rail 114. Furthermore, the toy element 108 may include a resilient or flexible tab 136, which interfaces with grooves 138 formed on the top of the rail 114. Receipt of the tab 138 within a particular groove 138 may keep the toy element 108 in a preferred position along the rail 114 when not being pushed or pulled by the child. In the exemplary embodiment, the toy elements 108 of the three rail stations 38 take the shapes of an elephant, turtle, and giraffe, although it is understood that the toy elements 108 may each take on any shape without departing from the spirit and scope of the present disclosure. For instance, the shapes of the toy elements 108 may include a car, train, truck, ball, character, food item, etc.

To use each rail station 38, the toy element 108 is initially connected to the rail station base 104 by depressing the locking tab 124 and aligning the groove 132 in the toy element 108 with the T-shaped rail 114. Once aligned, the toy element 108 is advanced over the rail 114, with the rail 114 being received within the groove 132. Once the toy element 108 is completely moved onto the rail 114, the locking tab 124 is released, thereby allowing the spring 128 to move the locking tab 124 to the locked position. The toy element 108 may then be played with by the child by moving the toy element 108 along the rail 114. The toy element 108 is retained on the rail 114 on one end via the locking tab 124, and on the other end via the end wall 122. In other words, should the toy element 108 reach an end of the rail 114, the toy body 130 will contact either the locking tab 124 or the end wall 122 to keep the toy element 108 on the rail 114.

To remove the toy element 108 from the rail 114, the locking tab 124 is depressed, and the toy element is moved toward the depressed locking tab 124, and continuous to move over the locking tab 124, and eventually away from the rail 114. Once the toy element 108 passes over the locking tab 124, the locking tab 124 may transition back to the locked position.

It is contemplated that the toy element 108 may be removed from the rail 114 for several different reasons. One reason may be to transition the entertainer 10 from the seat support configuration to the table top configuration. Along these lines, the toy elements 108 may be removed from the corresponding rails 114 to allow the multi-purpose plate 18 to be placed on top of the tray 14, as explained in more detail above. Each rail 114 defines a low profile, such that once the corresponding toy element 108 is removed, the rail 114 does not interfere with the multi-purpose plate 18 when the multi-purpose plate 18 is placed over the tray 14. When the entertainer 10 is in the table top configuration, the toy elements 108 may be stowed in the seat 12, or played with by the child on top of the table. Another reason the toy elements 108 may be removed from the rails 114 is to replace any broken toy element 108, or swap out one toy element 108 for another toy element 108.

Figure 17:
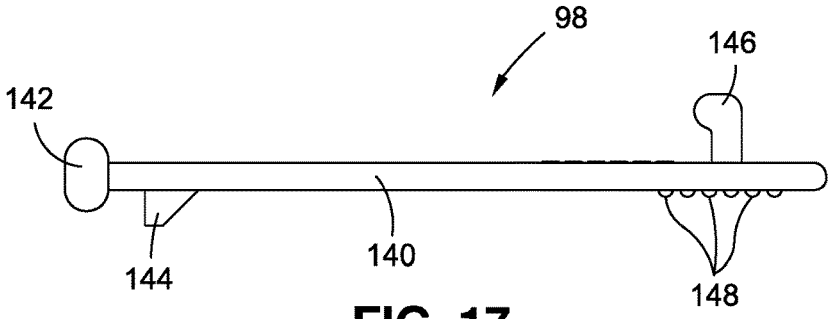
FIG. 17 is a side view of a strap used in connection with a multi-function plate included in the entertainer.

Referring now to FIGS. 17-22, one of the three identically straps 98 of the strap assembly preferably used to secure the multi-purpose plate 18 in the seat support configuration and the table top configuration is shown. FIG. 17 is a side view of the strap 98 showing various structural attributes of the strap 98. The strap 98 generally includes a main body 140, an enlarged end portion 142, a barb 144, a locking tab 146, a plurality of finger grips 148, and a slot 150. The enlarged end portion 142 is formed on one end of the strap 98 and is configured to retain the strap 98 in a corresponding one of three identically configured cavities 152 formed by the multi-purpose plate 18. The barb 144 extends away from the main body 140 in slightly spaced relation to the enlarged end portion 142, and serves as a stop or abutment which contacts the peripheral sidewall 22 of the multi-purpose plate 18 when the strap 98 is connected to the multi-purpose plate 18. The locking tab 146 extends from the main body 140 in direction opposite to that which the barb 144 extends. The locking tab 146 includes an enlarged end portion to facilitate engagement with a corresponding one of three identically configured locking grooves 154 formed in the tray 14. The finger grips 154 include a series of ridges or nubs which enhance the manual grip of the strap 98, as will be described in more detail below.

Figure 18:
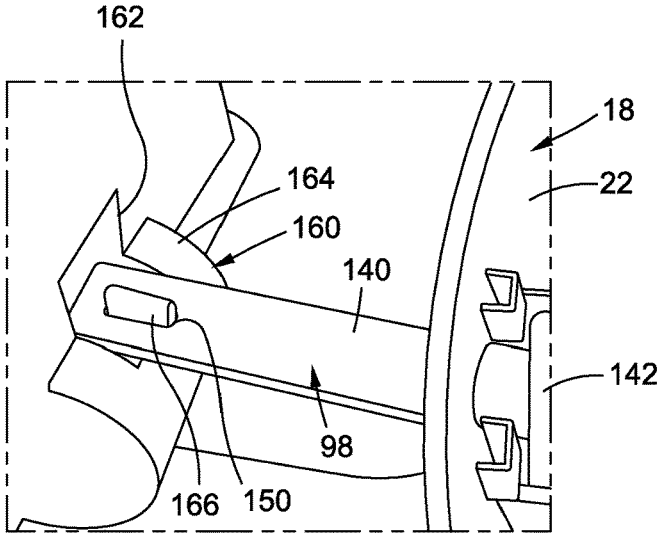
FIG. 18 is an upper perspective view of the strap as used when the entertainer is in the seat support configuration, the strap extending between a leg of the entertainer and the multi-function plate.
Figure 19:
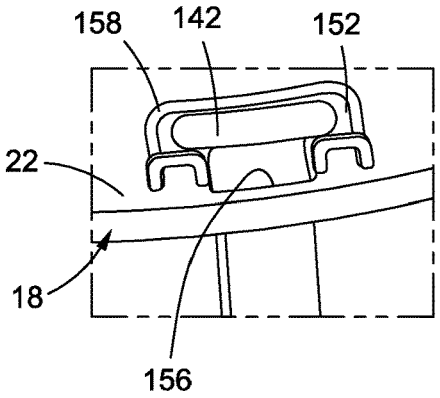
FIG. 19 is an enlarged top view of an end portion of the strap as coupled to the multi-function plate.
Figure 20:
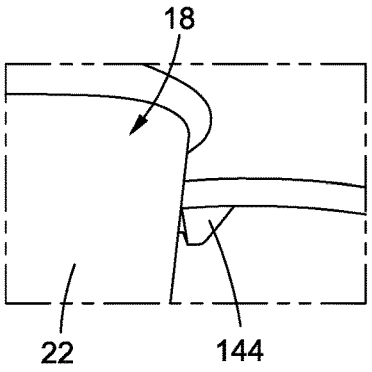
FIG. 20 is an enlarged side view of the multi-function plate and the strap as extending from the multi-function plate.

Referring now specifically to FIGS. 18-20, the engagement between one strap 98 and the multi-purpose plate 18 is depicted, the manner of engagement being the same for the remaining two straps preferably included in the strap assembly. As can be best seen in FIG. 19, the multi-purpose plate 18 includes three slots 156 or openings (spaced at intervals of about 120°) formed in the peripheral sidewall 22. For each slot 156, a corresponding wall 158 extends from the peripheral sidewall 22 around the slot 156 to form the recess or cavity 152 in communication with the slot 126. A corresponding strap 98 is connected to the multi-purpose plate 18 by advancing the enlarged end portion 142 of the strap 98 through the slot 156 until it is received within the cavity 152. The strap 98 is formed of a resilient material which allows the strap 98 to pass through the narrower slot 156 when urged therethrough by an adult user. The wall 158, along with the barb 144 prevent the strap 98 from being advanced too far through the slot 156. The enlarged end portion 142 is retained in the cavity 152 to maintain engagement between the strap 98 and the multi-purpose plate 18. The strap 98 remains engaged with the multi-purpose plate 18 when the entertainer 10 is in both the seat support configuration and the table top configuration.

When the entertainer 10 is in the seat support configuration, the strap 98 extends between the multi-purpose plate 18, and a respective leg 16 of the entertainer 10. Each leg 10 includes a foot 160 formed adjacent the lower end of the leg 16 adapted to engage with the corresponding strap 98. As shown in FIG. 18, one embodiment of the foot 160 includes an opening 162 or recess formed in the corresponding leg 16, along with a support element 164 extending from the opening 162. The support element 164 includes a groove aligned with the opening 162, and a fin 166 sized to extend through the slot 150 of the corresponding strap 98 to connect the leg 16 to the strap 98.

Figure 21:
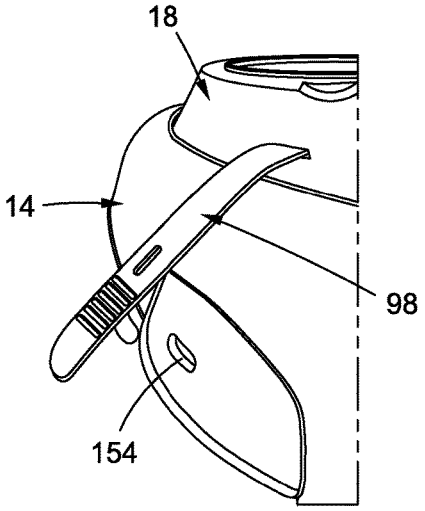
FIG. 21 is an upper perspective view of strap extending from the multi-function plate and disconnected from the tray, with the multi-function plate residing on the tray of the entertainer.
Figure 22:
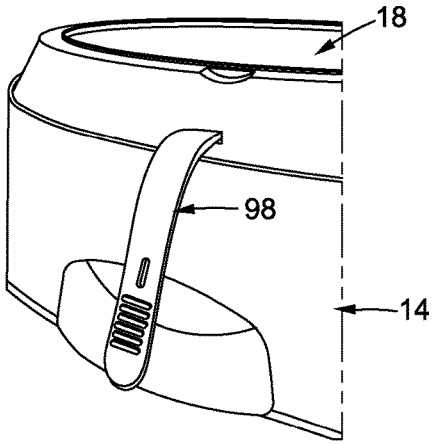
FIG. 22 is an upper perspective view of the strap as connected to both the multi-function plate and the tray when the entertainer is in the table-top configuration.

To transition the multi-purpose plate 18 from the seat support configuration to the table top configuration, all of the straps 98 are disengaged from their respective legs 16 by lifting each strap 98 to remove the fin 166 from the slot 150, and withdrawing the strap 98 from the opening 162 in the corresponding leg 16. Referring now specifically to FIGS. 21 and 22, when the multi-purpose plate 18 is in the table top configuration, the straps 98 are aligned with corresponding grooves 154 formed in the tray 41. In this regard, the tray 14 may include locking grooves 154 arranged around the periphery of the tray 14 by the same spacing that the straps 98 are spaced along the periphery of the multi-purpose plate 18. FIG. 21 shows one strap 98 disengaged from its corresponding locking groove 154, while FIG. 22 shows the strap 98 engaged with the locking groove 154. To engage any strap 98 with its corresponding locking groove 154, the locking tab 146 is advanced into the groove 154 by pressing the locking tab 146 into the groove 154. The finger grips 148 are positioned on the main body 140 opposite the locking tab 146 to allow a user to grip the end of the strap 98 and press against the finger grips 148 with their thumb. To disengage the strap 98 from its corresponding locking groove 154, the strap 98 is gripped by the user, again, with the user's thumb on the finger grips 148, and the strap 98 is pulled away from the locking groove 154.

Figure 23:
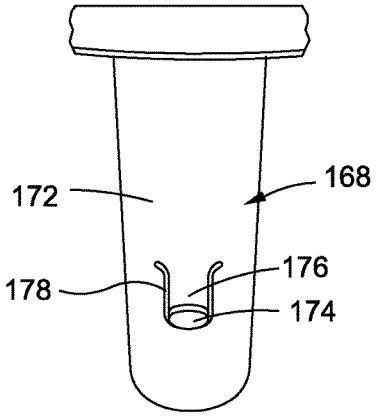
FIG. 23 is a front view of an upper leg portion of one of three identically configured support legs which are each pivotally connected to the tray and selectively movable between extended and folded or collapsed positions relative thereto.

Referring now to FIG. 23 and FIG. 1, the attributes of the legs 16 which allows for selectively adjustability of the height of the tray 14 above the floor surface will now be described. Each leg 14 includes an upper body 168 and a lower body 170 moveable relative to the upper body 168. The upper body 168 is pivotally connected to the tray 14 and includes a main body 172 and a lock button 174 moveable relative to the main body 172 and connected to the main body 172 via a tab 176. Movement of the lock button 174 relative to the main body 172 may be effectuated through a groove 178, which extends around the tab 176 and lock button 174. In one embodiment, the groove 178 is a U-shaped groove having its open end facing away from the lower body 170 (i.e., toward the tray 14 when the leg 16 is upright).

The lower body 170 is a sleeve that extends around a portion of the upper body 168, and is adapted to allow the upper body 168 to be selectively advanced into the lower body 170 to shorten the effective height of the entertainer 10. Alternatively, the upper body 168 may be selectively withdrawn from the lower body 170 to increase the effective height of the entertainer 10. The lower body 170 includes a series of openings 180 formed therein and arranged in an array, with each opening 180 corresponding to a different height of the entertainer 10. The lock button 174 is received within one of the openings 180 to set the height of the entertainer 10. In the exemplary embodiment, each lower body 170 includes three openings 180 to define three preset heights.

To modify the height of the entertainer 10, the user simply presses the lock button 174 until the lock button 174 is completely withdrawn from the corresponding opening 180 and no longer interferes with the lower body 170, thereby allowing the upper body 168 to move relative to the lower body 170. The upper body 168 is moved until it is aligned with the desired opening 180, which allows the lock button 174 to extend therethrough. In this regard, the inherent resiliency of the tab 176 urges the lock button 174 through the opening 180 when the lock button 174 is aligned with the opening 180. This adjustment process is repeated on each leg 16 until the length of each leg 16 is equal. It will be recognized that the lower body 170 of each leg 16 further defines a corresponding foot 160 as described above for accommodating a corresponding strap 98 of the strap assembly.

Referring now to FIGS. 24-28, in the entertainer 10, identically configured leg pivots 182 are used to pivotally connect each leg 16 to the tray 14, and will be described below. Along these lines, it is understood that each leg 16 will have a corresponding opposed pair of leg pivots 182 connecting it to the tray 14, with the simultaneous actuation of each leg pivot 182 of the pair optimally being used to facilitate movement of the corresponding leg 16 relative to the tray 14, such simultaneous actuation at least being necessary for movement of the leg 16 from the extended or deployed stated to the folded or collapsed state. However, the following discussion will focus on a single leg pivot 182, for purposes of simplicity.

Figure 26:
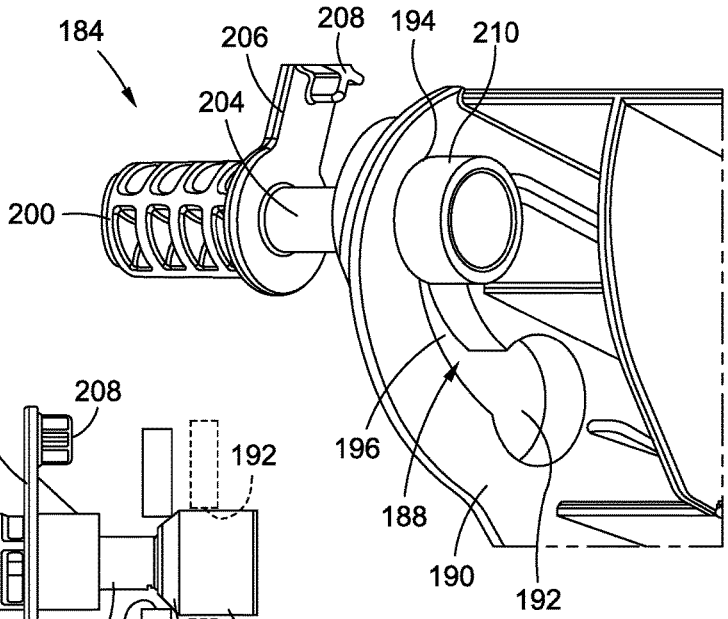
FIG. 26 is a perspective view depicting portions of the leg pivot corresponding to a respective support leg, including a pivot pin interfacing with a pivot groove formed in a pivot plate.
Figure 27:
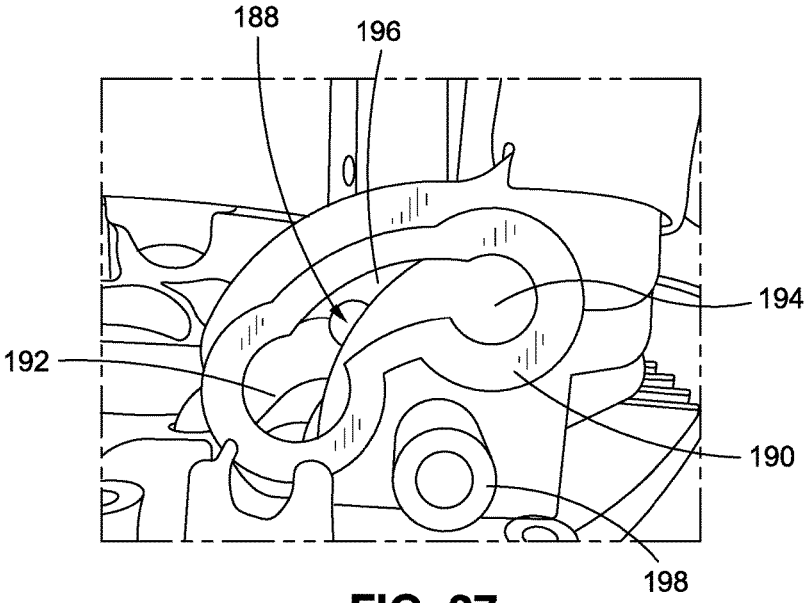
FIG. 27 is a side elevational view of a main housing of the leg pivot including the pivot guide slot.
Figure 28:
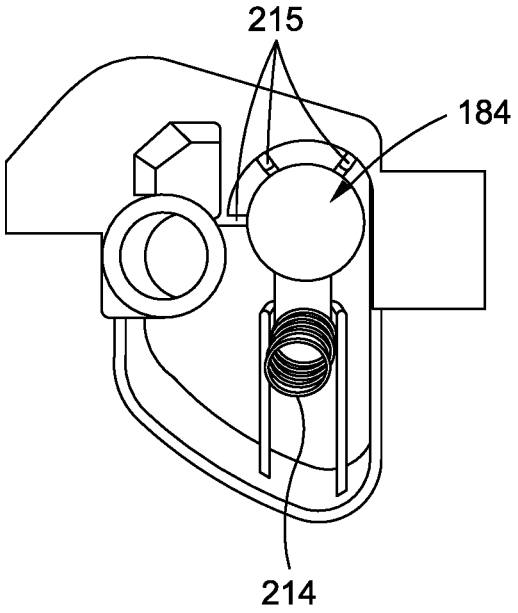
FIG. 28 is a side elevational view of one of two opposed, mirror image actuator mechanisms included in each leg pivot.

Each leg pivot 182 includes a pivot pin 184, a pivot housing 186, and a pivot groove 188 coupled to the upper body 168 of the leg 16. With regard to the pivot groove 188, as shown in FIGS. 26 and 27, each lateral side of the upper body 168 of each leg 16 includes a pivot plate 190 coupled thereto. The pivot plate 190 includes the pivot groove 188, which includes three discrete sections: a large opening 192, a small opening 194 having a reduced diameter relative to the large opening 192, and an arcuate groove segment 196 extending between the large opening 192 and the small opening 194. The arcuate groove segment 196 defines a width as the distance between the opposing edges of the pivot plate 190 that define the groove 188. Adjacent the pivot plate 190 is a cylindrical body 198 having a central opening adapted to receive a spring, as will be described in more detail below.

Figure 26A:
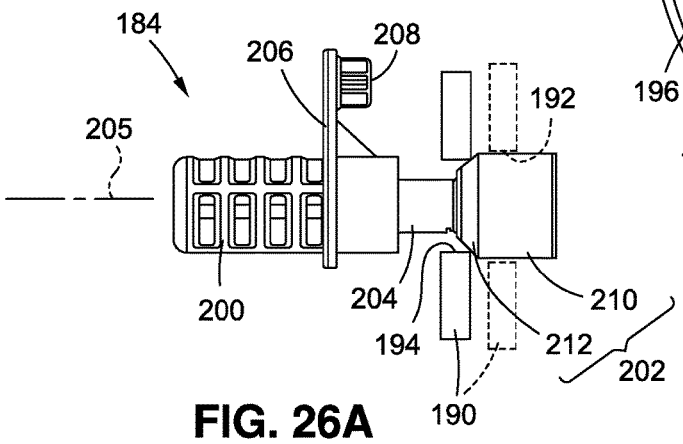
FIG. 26A schematically shows a pivot pin in first and second positions relative to the pivot plate, the first position being shown in solid lines and the second position being shown in dotted lines.

With reference now specifically to FIGS. 26 and 26A, the pivot groove 188 is adapted to interface with the pivot pin 184 to control the pivoting action of the leg 16 relative to the tray 14. For purposes of clarity, it should be noted that in FIG. 26, the pivot pin 184 is shown interfacing with the pivot groove 188. Whereas FIG. 26A schematically represents the position of the pivot pin 184, relative to the pivot plate 190 when the pivot pin 184 is in two different positions along the pivot groove 188. In other words, the two pivot plates 190 shown in FIG. 26A are not intended to depict the pivot pin 184 simultaneously extending through two separate pivot plates 190. Rather, the two pivot plates 190 are representative of two different positions of the pivot pin 184, relative to a common pivot plate 190, at two different moments in time.

Each pivot pin 184 includes an actuating body 200, a main body 202, and a shaft 204 extending between the actuating body 200 and the main body 202. The actuating body 200, main body 202, and shaft 204 are aligned along a common pin axis 205. Each pivot pin 184 additionally includes a flange 206 positioned between the actuating body 200 and the shaft 204, with the flange 206 extending radially outward relative to the shaft 204 and including an extension segment having a spring retainer 208 extending therefrom. The exemplary spring retainer 208 includes a cross or X-shaped projection extending from the extension segment of the flange 206.

The main body 202 of each pivot pin 184 itself includes two discrete regions, namely, a large region 210 that is of a constant diameter, and a chamfered region 212 positioned between the large region 210 and the shaft 204, with the chamfered region 212 having a tapered diameter that decreases from the large region 210 toward the shaft 204.

Figure 24:
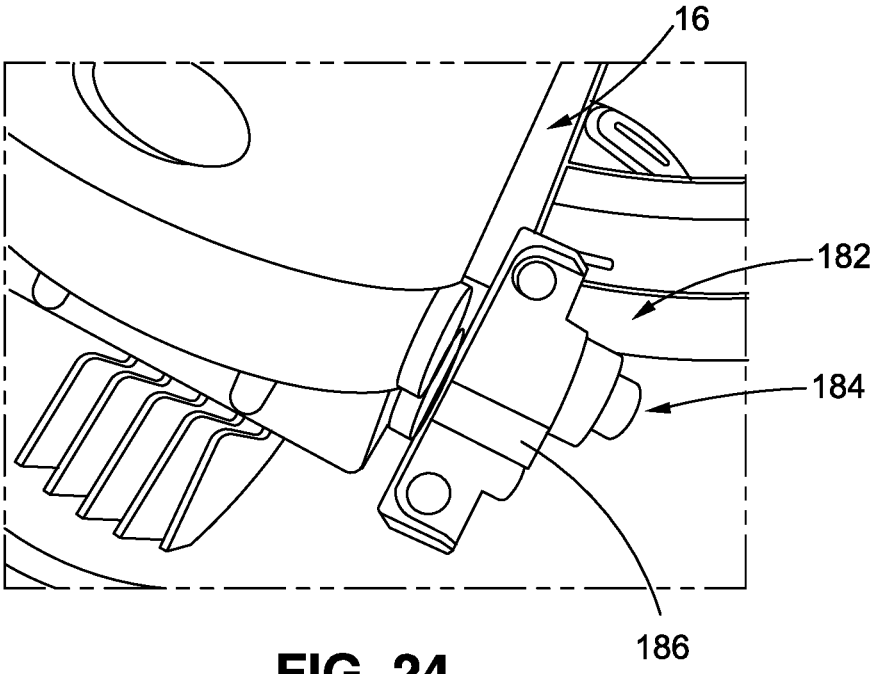
FIG. 24 is an upper perspective view of a leg pivot used to connect a corresponding one of the support legs to the tray.
Figure 25:
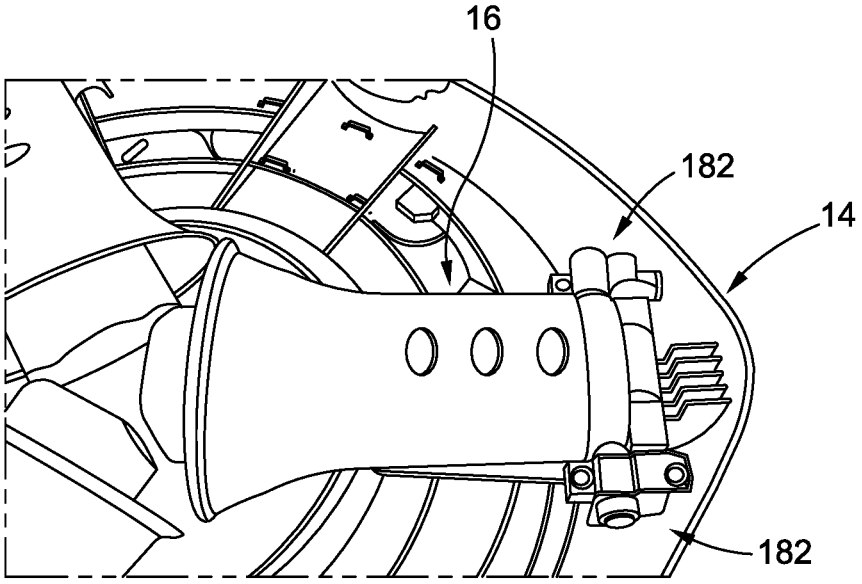
FIG. 25 is a bottom view of the entertainer depicting the support legs in respective folded or collapsed positions relative to the tray.

The pivot pin 184 is engaged with the pivot housing 186, which is mounted on the tray 14. As can be seen in FIGS. 24 and 25, two screws are used to secure each pivot housing 186 to the tray 14. The pivot housing 186 includes a cavity which receives a portion of the pivot pin 184. A plurality of ribs 215 may be integrated into the pivot housing 186 around a portion of the pivot pin to eliminate clearance between the pivot pin 184 and the pivot housing 186. An opening is formed in the pivot housing 186, with the opening being adapted to receive the actuating body 200 of the pivot pin 184 and allow the actuating body 200 to translate within the opening between a neutral position and an actuated position. A spring 214 acts on the pivot pin 184 to bias the pivot pin 184 to the neutral position. In particular, the spring 214 is positioned over the spring retainer 208, and extends into the central opening of the cylindrical body 198 and biases the pivot pin 184 away from the pivot plate 190.

During use, when the pivot pin 184 is in the neutral position, the main body 210 of the pivot pin 184 is received in the large opening 192 of the pivot groove 188. The biasing force of the spring 214 urges the flange 206 of the pivot pin 184 into contact with the pivot housing 186, and thus, the actuating body 200 of the pivot pin 184 protrudes a first distance from the pivot housing 186. This position of the pivot pin 184 corresponds to the leg 16 being deployed relative to the tray 14, with the leg 16 extending generally perpendicular from the tray 14. When the pivot pin 184 is received in the large opening 192, the pivot pin 184 is prevented from traveling within the groove 188, as the diameter of the large region 210 is larger than the width of the arcuate groove segment 196. Thus, the interaction between the pivot pin 184 and the pivot plate 190 locks the leg 16 in place in its extended or deployed position.

When the user wants to move the leg 16 from its deployed position to its collapsed or folded position, the user simply presses on the pivot pin 18, overcoming the biasing force of the spring 214, and advancing the pivot pin 184 along the pin axis 205 until the shaft 204 of the pivot pin 184 resides in the pivot groove 188. The diameter of the shaft 204 is smaller than the diameter of the large opening 192, small opening 194 and the width of the arcuate groove segment 196. Thus, when the shaft 204 resides within the pivot groove 188, the pivot pin 184 may be moved to any location of the pivot groove 188. Therefore, by pressing the pivot pin 184 from its neutral position to its actuated position, which moves the main body 202 out of the groove 188 and places the shaft 204 within the groove 188 (i.e., within the same plane as the groove 188), the leg 16 may be freely pivoted to its folded position. As the leg 16 pivots from the deployed position to the folded position, the shaft 204 of the pivot pin 184 travels in the groove 188 from the large opening 192, through the arcuate groove segment 196 until it reaches the small opening 194.

Once the shaft 204 is in the small opening 194, the leg 16 has assumed the folded position, as shown in FIG. 25, and thus, the pivot pin 184 may be released, which results in the pivot pin 184 moving from its actuated position to a partially neutral position. In particular, the biasing force of the spring 214 urges the pivot pin 184 away from the pivot plate 190 along the pin axis 205. The pivot pin 184 is configured such that the diameter of the large region 210 is larger than the diameter of the small opening 194. Accordingly, the large region 210 is prevented from being received in the small opening 194. However, the chamfered region 212 includes a taper, which has a minimum diameter smaller than that of the small opening 194, and a maximum diameter larger than that of the small opening 194. As such, the pivot plate 190 engages with the pivot pin 184 at the chamfered region 212. The engagement between the chamfered region 212 and the pivot plate 190 prevents the pivot pin 186 from freely moving within the pivot groove 188, thereby providing an impediment to the leg 16 moving from the folded position to the deployed position.

However, due to the taper defined by the chamfered region 212, the leg 16 is not "locked" in the folded position. Rather, in the event someone attempts to move the leg 16 from the folded position toward the deployed position without pressing the pivot pin 184, if enough force is applied to overcome the bias of the spring 214, the tapered configured of the chamfered region 212 causes the pivot pin 184 to interface with the pivot plate 190 in a manner which moves the pivot pin 184 along the pin axis 205, until the shaft 204 resides in the pivot groove 188. Once the shaft 204 is in the pivot groove 188, the leg 16 may be more freely transitioned to the deployed position, which corresponds to the large region 210 of the main body 202 being received in the large opening 192.

As an alternative to the foregoing, a user may transition the leg 16 from the folded position to the deployed position by pressing the pivot pin 184 to place the shaft 204 within the pivot groove 188 to allow the pivot pin 184 to freely transition from the small opening 194, through the arcuate groove segment 196, and into the large opening 192. The option of pressing the pivot pin 184 to allow for a more unrestricted transition from the folded configuration to the deployed configuration may be preferred, as it may reduce wear and tear on the pivot pin 184 and the pivot plate 190.

The tapered configuration of the chamfered region 212, and its interaction with the pivot plate 190 described above, is designed to protect the pivot pin 184 from breaking in the event a user forgets to press the pivot pin 184 to effectuate such transition. Along these lines, when conventional pivot pins or lock pins are used in articulating structures, users are sometimes mistakenly of the belief that the pin only functions as a lock when the articulating structure is in a deployed position, but does not function as a lock when the articulating structure is in a stowed position. Therefore, when the user attempts to move the articulating structure from its stowed position to its deployed position, the user may break the articulating structure, or perhaps cause injury to themselves.

The configuration of the chamfered region 212, and the interference with the pivot plate 190 attempts to serve the function of a locking pin, while at the same time mitigating damage to the entertainer 10 or injury to the user. Along these lines, the interference between the chamfered region 212 and the pivot plate 190, resulting from the relative configurations of the chamfered region 212 and pivot plate 190, as well as the bias applied by the spring 214, causes the leg 16 to remain in the folded position, unless a force is applied to the leg 16, which overcomes the interference between the chamfered region 212 and the pivot plate 190. According to some implementations, the interference between the pivot pin 184 and the pivot plate 190 is sufficient to retain the leg 16 in the folded configuration and resist the force of gravity. However, such interference may be overcome before the pivot pin 184 breaks.

Also, to reiterate the explanation given above, it will be understood that the aforementioned description regarding the interactive engagement of each pivot pin 184 to a corresponding pivot plate 190 (including the pivot groove 188 therein) is equally applicable to each of the opposed pair of leg pivots 182 used to pivotally connect each leg 16 to the tray 14. In this regard, the simultaneous actuation of the pivot pins 184 of the leg pivots 182 of the pair is needed to facilitate movement of the corresponding leg 16 from the expanded or deployed state to the folded or collapsed state. However, while such simultaneous actuation is optimally also used to facilitate movement from the folded state back to the deployed state, it is not essential due to the above-described functionality imparted by the chamfered regions 212 of the pivot pins 184.

The particulars shown herein are by way of example only for purposes of illustrative discussion, and are not presented in the cause of providing what is believed to be most useful and readily understood description of the principles and conceptual aspects of the various embodiments of the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. An entertainer for a child comprising:

a tray having a central opening;

a seat coupled to the tray adjacent the central opening;

a plurality of legs extending from the tray; and a plate selectively positionable relative to the tray to allow the entertainer to be selectively transitioned between a seat support configuration and a table top configuration;

wherein the plate is detachably connected to the plurality of legs in spaced relation to the tray in the seat support configuration, and is detachably connected to the tray to extend across the central opening in the table top configuration.

2. The entertainer of claim 1, further comprising at least one hinged toy pivotally coupled to the tray.

3. The entertainer of claim 2, wherein the at least one hinged toy is pivotable so as to extend between the plate and the tray when the tray is in the table top configuration.

4. The entertainer of claim 1, further comprising at least one toy element translatably coupled to the tray.

5. The entertainer of claim 1, further comprising at least one strap coupled to the plate, the strap being detachably connected to one of the plurality of legs when the plate is in the seat support configuration, and detachably connected to the tray when the plate is in the table top configuration.

6. The entertainer of claim 5, wherein the at least one strap includes a main body and a barb extending from the main body, the barb being postionable in contact with the tray when the at least one strap is connected to the tray.

7. The entertainer of claim 1, wherein each of the plurality of legs is pivotally coupled to the tray.

8. An entertainer for a child comprising:

a tray having a central opening extending around a central axis;

a seat coupled to the tray adjacent the central opening;

a plurality of hinged toys pivotally coupled to the tray, each of the hinged toys being transitional between an upright position and a collapsed position, at least a portion of each of the hinged toys moving toward the tray as it transitions from the upright position toward the collapsed position; and a plate selectively positionable on the tray and extendable over the seat and the plurality of hinged toys when the hinged toys are each in the collapsed position;

each of the hinged toys extending between the seat and the plate when the plate is positioned on the tray and the hinged toys are is in the collapsed position.

9. The entertainer of claim 8, further comprising a toy element translatably coupled to the tray.

10. The entertainer of claim 9, further comprising a rail coupled to the tray, the toy element being translatable along the rail.

11. The entertainer of claim 10, wherein the rail includes a plurality of grooves, and the toy element includes a flexible tab interfacing with the plurality of grooves as the toy element translates along the rail.

12. The entertainer of claim 8, further comprising a plurality of legs extending from the tray.

13. The entertainer of claim 12, wherein each of the plurality of legs is pivotally coupled to the tray.

14. The entertainer of claim 12, wherein the plate is in a first configuration when extending over the seat and the plurality of hinged toys, the plate further being positionable in a second configuration wherein the plate is connected to the plurality of legs.

15. The entertainer of claim 14, further comprising a plurality of straps coupled to the plate, the plurality of straps being engaged with the tray when the plate is in the first configuration, and the plurality of straps being engaged with respective ones of the plurality of legs when the plate is in the second configuration.

16. The entertainer of claim 8, wherein at least a portion of each of the hinged toys move toward the central axis as it transitions from the upright position toward the collapsed position.

17. The entertainer of claim 1 wherein each of the legs is pivotally connected to the tray by at least one leg lock comprising:

a pivot plate coupled to the leg and having a pivot groove formed therein; and a pivot pin defining a pin axis, the pivot pin extending in the pivot groove;

the pivot pin and pivot groove collectively restricting movement of the pivot pin when the pivot pin is in a first axial position and a first portion of the pivot pin is in a first portion of the groove;

the pivot pin being moveable along the pin axis from the first axial position to move the first portion of the pivot pin out of the pivot groove to allow for selective movement of another portion of the pivot pin within the pivot groove;

the pin being positionable in a second axial position along the pin axis to create an interference between the pivot pin and the pivot plate.

18. The entertainer of claim 17, wherein:

the pivot plate includes a first opening that is of a first diameter, a second opening that is of a second diameter less than the first diameter, and an arcuate groove extending between the first opening and the second opening;

the pivot pin includes an actuating body, a shaft, and a main body having a maximum diameter region and a variable diameter region having a diameter no greater than the maximum diameter region;

the maximum diameter region has a diameter less than the first diameter, and greater than the second diameter; and the shaft being freely moveable within the pivot groove when the shaft is located within the pivot groove.

19. The entertainer of claim 17, further comprising a plurality of toys coupled to the tray.

20. The entertainer of claim 19, wherein at least one of the plurality of toys is pivotally coupled to the tray.

21. The entertainer of claim 19, wherein at least one of the plurality of toys includes a rail coupled to the tray and a toy element translatable along the rail.

* * * * *